United States Patent [19]

Estandian

[11] 4,083,103

[45] Apr. 11, 1978

[54] ADJUSTABLE SAFETY RAZOR

[76] Inventor: Ramon D. Estandian, 3922-18th St., San Francisco, Calif. 94114

[21] Appl. No.: 770,894

[22] Filed: Feb. 22, 1977

Related U.S. Application Data

[63] Continuation-in-part of Ser. No. 614,792, Sep. 19, 1975, abandoned.

[51] Int. Cl.[2] ..... B26B 21/06; B26B 21/52

[52] U.S. Cl. ..... 30/47; 30/89

[58] Field of Search ..... 30/38, 39, 48, 57, 58, 30/87, 88, 89, 321

[56] References Cited

U.S. PATENT DOCUMENTS

| | | | |
|---|---|---|---|
| 831,259 | 9/1906 | Bingler | 30/89 X |
| 1,552,234 | 9/1925 | Roebuck | 30/89 |
| 2,113,772 | 4/1938 | Rothschild | 30/48 X |
| 2,162,388 | 6/1939 | Rockwell | 30/87 |

*Primary Examiner*—Gary L. Smith

[57] ABSTRACT

Razor having a head for holding a blade, a tubular handle having an upper end near the head and a lower end remote from the head, a first shaft within the handle, a first gear fixed to the upper end of the first shaft, a second shaft fixed to the head, a second gear fixed to the second shaft and meshing with the first gear to effect rotation of the head when the first shaft is rotated, an operating member fixed to the lower end of the first shaft, a disc fixed to the first shaft slightly below the lower end of the handle and a screw ring threaded on to the lower end of the handle to allow locking the head in adjusted position by thrusting the disc against lower end of the handle.

1 Claim, 6 Drawing Figures

FIG-4
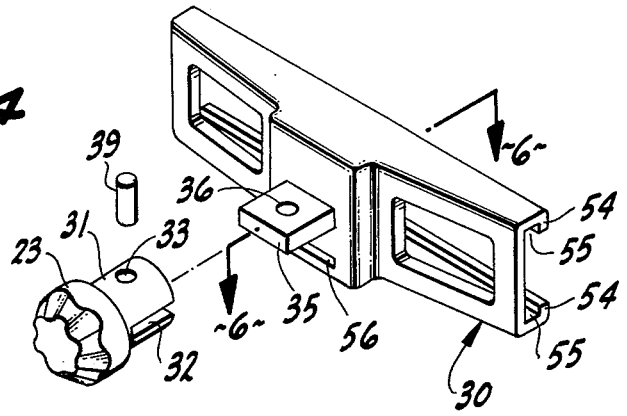
FIG-5
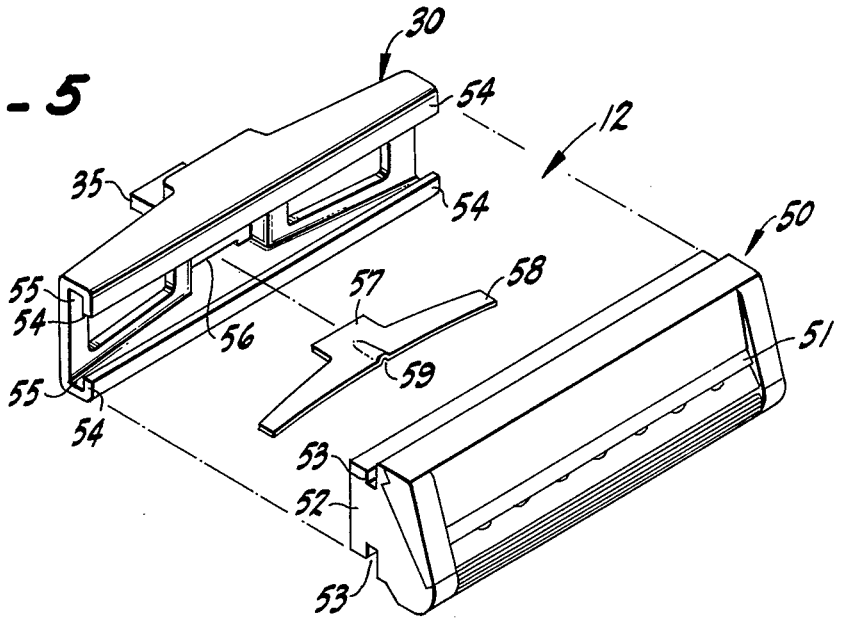
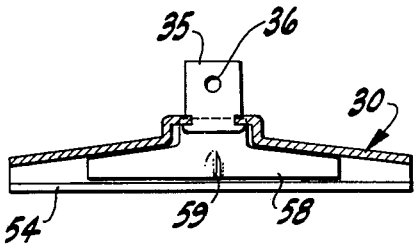
FIG-6

ADJUSTABLE SAFETY RAZOR

This invention is a continuation-in-part of application Ser. No. 614,792, filed Sept. 19, 1975, entitled "Adjustable Safety Razor", now abandoned.

This invention relates to a safety razor, the head of which may be of conventional construction such as the well known injector type head, or the type known as the Gillette razor, but wherein the head can be rotated and adjusted to achieve the optimum angle for shaving.

It is an object of the present invention to provide improvements in safety razors having an adjustable head.

It is a further and particular object of the present invention to provide an adjustable head for a safety razor which is simple in construction, which may be adjusted readily to any desired position and which is held firmly in that position until it is desired to move it to another position.

It is another object of this invention to provide a safety razor having a screw ring for readily setting the adjustable head in any given position.

The above and other objects of the invention will be apparent from the ensuing description and appended claims.

One embodiment of the invention is illustrated by way of example in the accompanying drawings, in which:

FIG. 4 is an exploded view showing the frame portion of the head and its means of attachment to one of a pair of gears which is employed to rotate the head;

FIG. 5 is an exploded view showing the frame of FIG. 4 from the front rather than from the rear and in conjunction with the head or blade-carrying member and a locking clip;

FIG. 6 is a top view of the frame portion.

Figure 1:
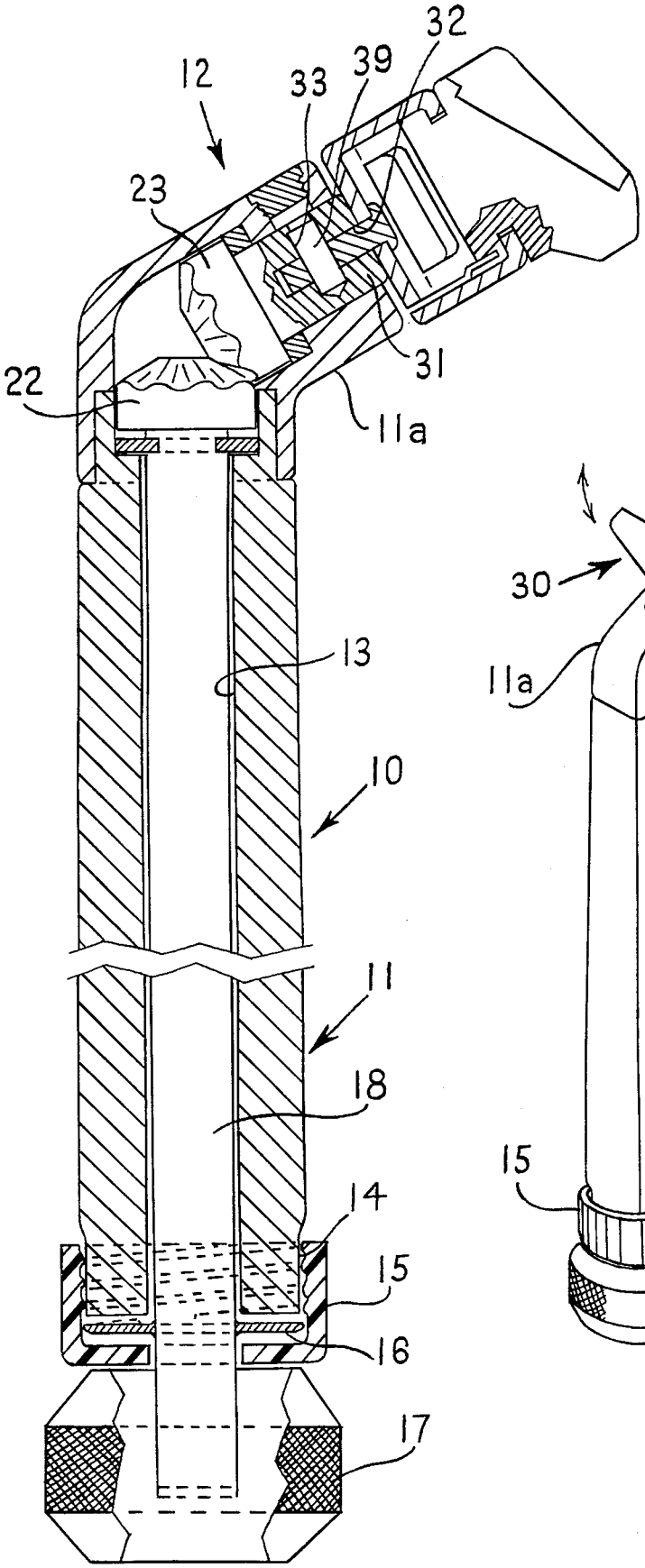
FIG. 1 is a view in vertical section through the razor of the present invention.
Figure 2:
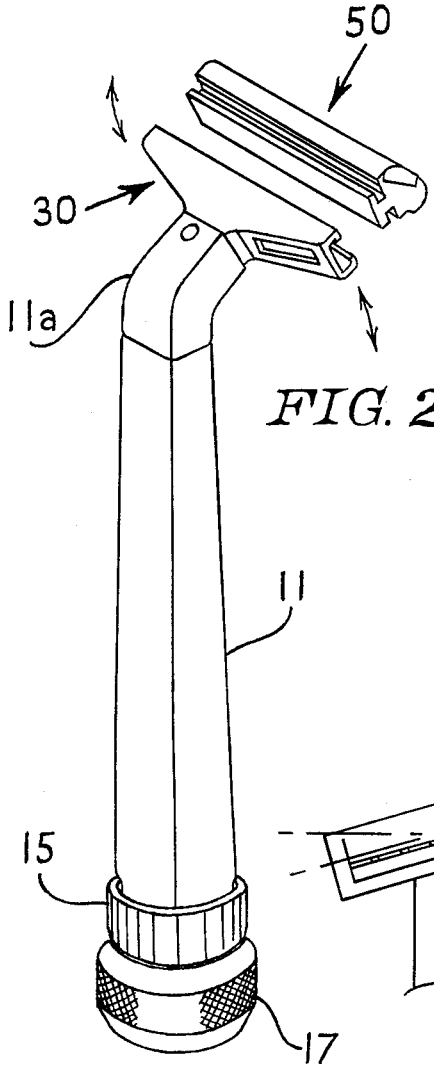
FIG. 2 is a respective view of the razor on a smaller scale than that of FIG. 1.
Figure 3:
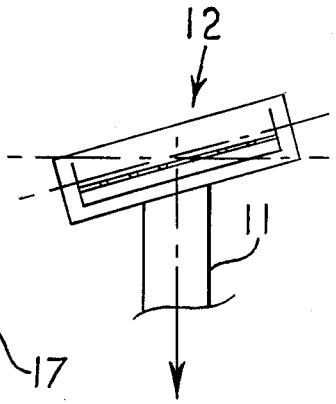
FIG. 3 is a front view of the head and a portion of the handle showing the way in which it is rotated.

Referring now to the drawings and preliminarily to FIG. 1, the razor is indicated in its entirety by the reference numeral 10 and comprises a tubular handle 11 and a head 12. The tubular handle 11 has an axial passage 13 which is threaded at its lower end 14 to receive screw ring 15. A disc 16 is secured to shaft 18 such that the screw ring 15 will abut the disc 16 and move the shaft 18 in an upward direction when the screw ring 15 is tightened.

A knurled knob 17 is provided which is affixed to shaft 18. The shaft 18 has a gear 22 which meshes with and drives a second gear 23. Tightening of screw ring 15 moves gear 22 firmly against gear 23 to lock the head 13 in position. As will be seen, the gears 22 and 23 are bevel gears to permit a 45° angle in the head 11. A housing or extension 11a is provided which fits over the upper end of the tubular handle 11 and which is bent angularly at 45° as shown.

Referring now to FIG. 4 as well as to FIG. 1, the frame or holder component for the head 12 is shown and is generally designated by the reference numeral 30.

The gear 23 has a shaft 31 formed with a slot 32 and with a hole 33 extending through the shaft perpendicularly to the slot 32. The frame or blade holder 30 is provided with a tongue 35 formed with a hole 36. A pin 39 is provided, and as will be seen in FIG. 1 the shaft 31 of gear 23 fits over the tongue 35 and is held in place by the pin 39. A threaded opening 40 is provided in the upper extremity of the tubular extension 11a of spindle 11 and a screw 41 is provided which locks the pin in place. When it is desired to detach the head 12 the screw 41 is removed, the pin 39 is removed and the head is removed.

As shown in FIGS. 4 and 5, the frame or blade holder 30 is formed with opposing flanges 54 which form slots 55. At its mid-portion and rear the blade holder 30 is formed with a slot 56 to receive the tail portion 57 of a clip 58 having a rib or detent 59 formed at its forward mid-portion.

The detachable blade, generally designated by the reference numeral 50, is of conventional type and includes a blade proper 51. It has a T-shaped rearward projection 52 forming slots 53. As will be seen, this T portion is slipped into the grooves 55 of the frame member 30 with the clip 58 in place in the slot 56. The lower edge of the blade 50 is formed with a slot 60 matching the detent 59 so that when the head 50 is thrust inward this slot will snap over the detent 59 and the blade will be locked in place but can be removed manually without difficulty.

To adjust the head 12 it is only necessary to loosen screw ring 15 and turn knob 17 in either direction to obtain the desired position of the head. The screw ring 15 is then tightened to hold the head 11 in a firm setting. The head 15 can thus be adjusted and firmly set in great ease.

The head 12 may be of different design than that shown in the drawings and described above. For example, it may be provided with double blades and these may be parallel, converging or diverging. The construction shown in U.S. Pat. No. 3,768,162 may be used, for example.

It will therefore be apparent that an adjustable razor has been provided having advantages of simplicity, a wide range of adjustability and retention of any adjusted position.

I claim:

1. A safety razor comprising a tubular handle having an upper end and a lower end, a first shaft disposed within the handle, an operating member at the lower end of the handle for rotating the first shaft, a head portion adapted to hold a blade, a second shaft affixed to the head, a first gear affixed to the first shaft at its upper end, a second gear meshing with the first gear and affixed to the second shaft at its end remote from the head and means at the lower end of the shaft above the operating member for locking the gears at a desired setting, said means comprising a disc affixed to the first shaft slightly below the lower end of the tubular handle, a screw ring enclosing the disc and a threaded portion of the lower end of the handle, such that when the screw ring is tightened its lower surface will abut the disc and urge the first shaft upwardly to lock the gears at a desired setting.

* * * * *